US008763187B2

(12) United States Patent
Mastio et al.

(10) Patent No.: US 8,763,187 B2
(45) Date of Patent: Jul. 1, 2014

(54) APPARATUS FOR CLEANING AN IMMERSED SURFACE HAVING A SINGLE REVERSIBLE ELECTRIC DRIVING AND PUMPING MOTOR

(75) Inventors: Emmanuel Mastio, Fourquevaux (FR); Philippe Blanc-Tailleur, Toulouse (FR); Philippe Pichon, Villeneuve de Riviere (FR)

(73) Assignee: Zodiac Pool Care Europe, Paris (FR)

( * ) Notice: Subject to any disclaimer, the term of this patent is extended or adjusted under 35 U.S.C. 154(b) by 428 days.

(21) Appl. No.: 12/971,236

(22) Filed: Dec. 17, 2010

(65) Prior Publication Data

US 2011/0154585 A1 Jun. 30, 2011

Related U.S. Application Data

(60) Provisional application No. 61/300,534, filed on Feb. 2, 2010.

(30) Foreign Application Priority Data

Dec. 18, 2009 (FR) ..... 09 06137

(51) Int. Cl.
*E04H 4/16* (2006.01)

(52) U.S. Cl.
USPC ..... 15/1.7

(58) Field of Classification Search
CPC ..... E04H 4/16; E04H 4/1654; E04H 4/1663
USPC ..... 15/1.7
See application file for complete search history.

(56) References Cited

U.S. PATENT DOCUMENTS

| | | | | |
|---|---|---|---|---|
| 5,245,723 | A | 9/1993 | Sommer | |
| 5,337,434 | A * | 8/1994 | Erlich | 15/1.7 |
| 6,652,742 | B2 * | 11/2003 | Henkin et al. | 210/167.16 |
| 7,213,287 | B2 * | 5/2007 | Hui | 15/1.7 |
| 2004/0021439 | A1 | 2/2004 | Porat et al. | |
| 2004/0168838 | A1 | 9/2004 | Erlich et al. | |

FOREIGN PATENT DOCUMENTS

| | | |
|---|---|---|
| EP | 1022411 | 7/2000 |
| EP | 1070850 | 1/2001 |
| FR | 2567552 | 1/1986 |
| FR | 2584442 | 1/1987 |
| FR | 2896005 | 7/2007 |
| FR | 2925553 | 6/2009 |
| WO | WO8700883 | 2/1987 |
| WO | WO02092189 | 11/2002 |
| WO | WO2009081060 | 7/2009 |

* cited by examiner

*Primary Examiner* — Laura C Guidotti
(74) *Attorney, Agent, or Firm* — Dean W. Russell; Kilpatrick Townsend & Stockton LLP

(57) ABSTRACT

The invention relates to an apparatus for cleaning a surface which is immersed in a liquid, comprising a hollow body, guiding and driving members, a filtration chamber in the hollow body, at least one liquid inlet, at least one liquid outlet out of the hollow body, at least one axial pumping propeller, a single reversible electric motor whose drive shaft, in order to move it, is simultaneously mechanically connected to at least one motorized member and to each pumping propeller. In a first rotation direction of the drive shaft, each motorized member is driven in a forward direction, and each pumping propeller generates the flow of liquid in the normal direction ensuring the cleaning of the immersed surface. In a second rotation direction of the drive shaft, each motorized member is driven in a backward direction opposite the first direction.

12 Claims, 8 Drawing Sheets

Figure 1:
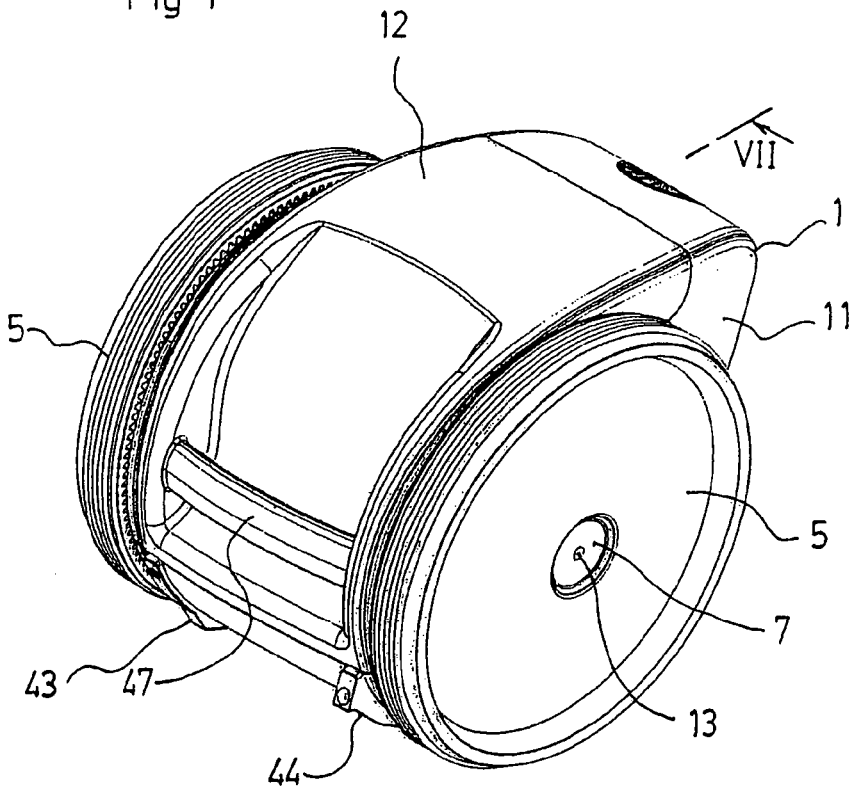
Figure 2:
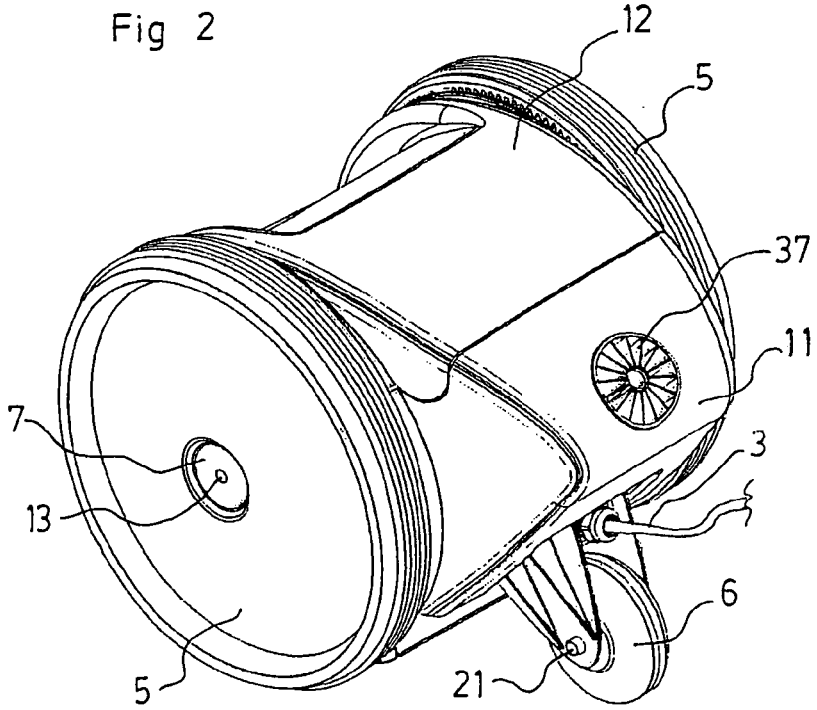
Figure 3:
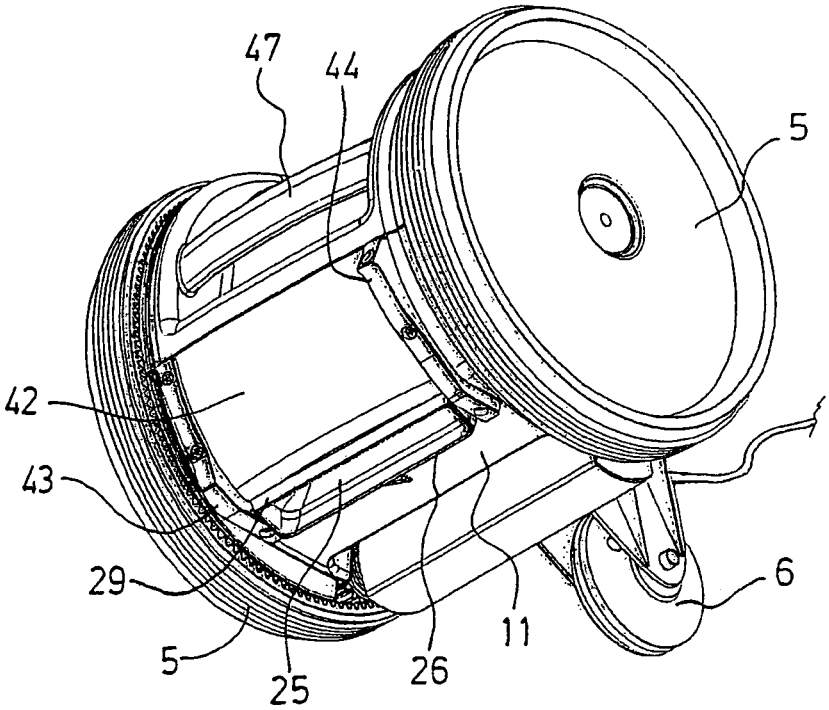
Figure 4:
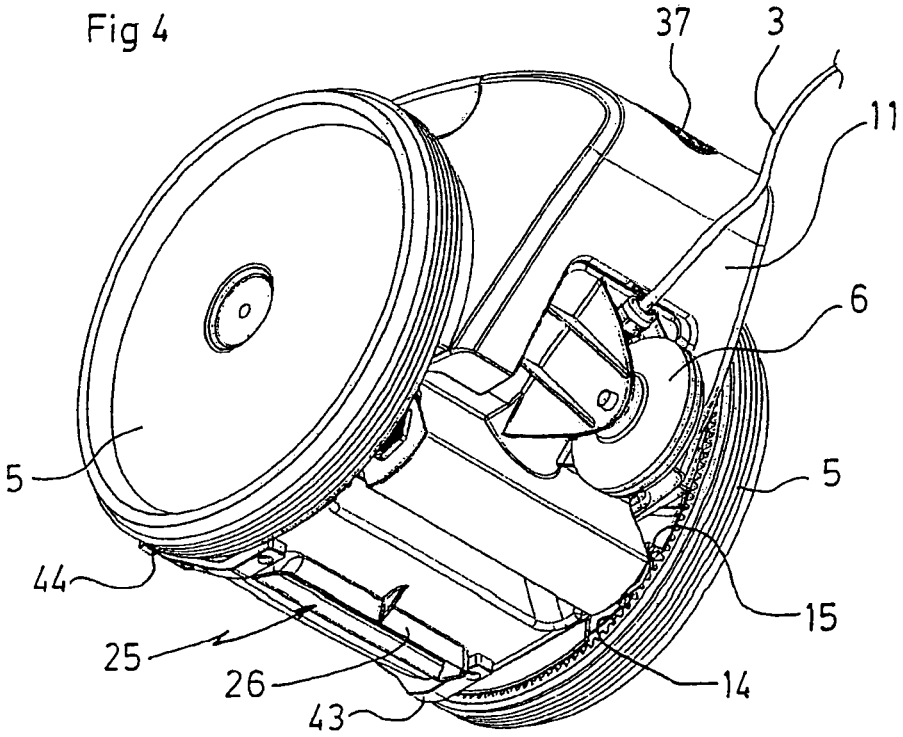

12
28
33
5
37
11
6
14
42
43
44
27

APPARATUS FOR CLEANING AN IMMERSED SURFACE HAVING A SINGLE REVERSIBLE ELECTRIC DRIVING AND PUMPING MOTOR

This application claims the benefit of French Patent Application No. 09.06137 filed on Dec. 18, 2009 and claims the benefit of U.S. Provisional Application No. 61/300,534 filed on Feb. 2, 2010, the contents of both of which are incorporated herein by reference.

The invention relates to an apparatus for cleaning a surface which is immersed in a liquid, such as the walls of a swimming pool, of the self-propelled type having an electric motor.

There are a great number of apparatus of this type which have been known for some time (cf. typically FR 2 567 552, FR 2 584 442, etc.) and they generally comprise a hollow body; one (or more) electric drive motor(s) which is/are coupled to one or more member(s) for driving the body over the immersed surface; and an electric pumping motor which drives a pumping member, such as a propeller, which generates a liquid flow between at least one liquid inlet and at least one liquid outlet and through a filtration chamber.

These apparatus are satisfactory but are relatively heavy and costly to produce and use, in particular in terms of electrical consumption.

There have already been proposed apparatus having a single electric motor which serves to simultaneously bring about the driving of the apparatus and the pumping of the liquid. However, these simplified apparatus suffer from mediocre performance levels, in particular in terms of cleaning efficiency (speed and/or quality of sweeping the entire surface and/or debris pumping capacity).

If the motor is optimized to drive the apparatus to carry out a sweeping coverage which is as rapid and complete as possible, it cannot at the same time be optimized for the pumping and filtration of debris. In particular, optimized driving assumes bends to the left and to the right, stops, even reversals of the drive direction. The alterations of the operation of the motor to comply with these trajectory restrictions necessarily reduce the efficiency of the pumping member and/or the hydraulic circuit (by bringing about pressure drops) and some—in particular pumping in the backflow direction in the filtering device—are a priori unacceptable unless specific and complex arrangements are provided (pumping member generating a flow in the same direction regardless of the drive direction of the motor).

In particular, until now, in prior apparatus in which the pumping is provided by an on-board electric motor, and the driving is also ensured by at least one on-board electric motor, if the apparatus must be bi-directional, that is to say, able to carry out forward and backward trajectories, the possibility of using the same electric motor for the pumping and for moving the apparatus is excluded, unless a pumping member such as a "vortex" pump or a centrifugal pump is provided (cf. for example U.S. Pat. No. 5,245,723), or with articulated blades (cf. for example EP 1 070 850), which is capable of providing a flow of liquid in the same direction regardless of the rotation direction thereof, but whose pumping performance levels are mediocre.

In another category of apparatus, there is provision for the driving of the apparatus to be at least partially carried out by the hydraulic reaction brought about by the flux generated by the pumping action. In this manner, for example, EP 1 022 411 (or US 2004/0168838) describes an apparatus which is capable of being partially driven by the hydraulic flux created and has two nozzle outlets which have opposing directions and which are supplied alternately by a valve which is operated when the pump is stopped. However, apparatus of this type are relatively complex, costly and unreliable, in particular with regard to the control of the tilting of the valve (or more generally for the change in direction of the hydraulic flux) which requires an operating logic unit and/or at least one on-board actuator and/or a specific mechanism which is capable of being locked.

An object of the invention is therefore generally to provide a cleaning apparatus of the type having an on-board electric motor which is both more economical in terms of production and use and which has high performance levels comparable with those of known apparatus, in terms of quality and cleaning, and more particularly which provide complete and rapid sweeping of the immersed surface and good suction quality for collecting waste with a satisfactory performance level in terms of energy.

An object of the invention is also to provide an apparatus of this type which is particularly simple, reliable, compact and light but which has significant movement possibilities, and which can in particular be driven in a straight line, or round a bend at one side or the other.

An object of the invention is also to provide an apparatus of this type whose electric control unit is particularly simple and economical and can be located entirely out of the liquid.

The invention therefore relates to an apparatus for cleaning a surface which is immersed in a liquid, comprising:

- a hollow body,
- guiding and driving members for guiding and driving said body over the immersed surface,
- a filtration chamber provided in said hollow body and having:
  - at least one liquid inlet into the hollow body,
  - at least one liquid outlet out of the hollow body,
  - a hydraulic circuit for circulation of liquid between each liquid inlet and each liquid outlet through a filtering device,
- at least one pumping member which is provided to generate a flow of liquid between each liquid inlet and each liquid outlet, each pumping member being formed by an axial pumping propeller with unidirectional pitch which creates a flux of liquid which is generally orientated along the rotation axis thereof,
- a single reversible electric motor carried by said hollow body, and comprising a drive shaft which is simultaneously mechanically connected to:
  - at least one of said guiding and driving members, called a motorized member, in order to move it,
  - each pumping propeller ,in order to move it,
- an electric control unit which is connected to said motor to supply it with electrical power and to control it:
  - in a first rotation direction of the drive shaft in which each motorized member is driven in a first direction, called a forward direction, and each pumping propeller generates the flow of liquid in the normal direction from each liquid inlet towards each liquid outlet in order to ensure the cleaning of the immersed surface and the filtration of the solid residue by the filtering device,
  - in a second rotation direction of the drive shaft in which each motorized member is driven in a second direction, called a backward direction, opposite the first direction.

Contrary to all the teachings of the prior art, an apparatus which has the combination of features of the invention may be simplified to an extreme degree, and in particular may have no actuator or electric motor other than the single electric motor which it comprises, may have no on-board logic circuit or automated control system, whilst in reality having high performance levels in terms of pumping, coverage and rapidity of sweeping. The apparatus can be driven forwards in the first rotation direction of the drive shaft for the majority of the time during which it carries out predetermined trajectories, for example substantially in a straight line, and in a backward direction corresponding to the second rotation direction of the drive shaft from time to time, as required (for example in order to withdraw from a blockage situation or after detecting a vertical wall) or at predetermined or random times for a short period of time. The inventors have surprisingly found that, in a backward direction, it is found that the rotation of the drive shaft in the second rotation direction is in reality not really detrimental statistically to the cleaning of the immersed surface, even if a flow of liquid in a backward direction may be generated. On the other hand, the periods of operation in a backward direction may be used to bring about a gyration of the apparatus at least at one side in an extremely simple and economic manner.

Advantageously and according to the invention, each pumping propeller is configured, in the second rotation direction of the drive shaft, to generate a non-zero flow of liquid in a backward direction from each liquid outlet in the direction of backflow towards each liquid inlet, preferably without reaching each liquid inlet. This being the case, it is easy to provide, in an apparatus according to the invention, arrangements which allow the backflow of debris via each liquid inlet in a backward direction to be minimized, or even prevented.

First of all, it is sufficient to make provision for the periods of time involving driving in the second rotation direction to be very short compared with the periods of time involving driving in the first rotation direction.

In this manner, advantageously and according to the invention, the electric control unit is configured to control the electric motor mainly in the first direction and for shorter periods of time in the second direction.

Furthermore, advantageously and according to the invention, the filtering device comprises at least one non-return valve which is arranged upstream of the filtering device relative to the flux of liquid in the normal pumping direction of the liquid, each non-return valve being arranged to prevent, in a backward direction, the backflow of the liquid out of the filtering device and out of the hollow body (in particular the backflow via each liquid inlet which is located at the base of the hollow body and via which the liquid enters the hollow body in the normal pumping direction). More particularly, advantageously and according to the invention, the filtering device has at least one inlet which is arranged upstream relative to the flux of liquid in the normal pumping direction of the liquid, and at least one valve is arranged at each inlet upstream of the filtering device.

It should be noted that short periods during which the flow of liquid is refluxed in a backward direction in the filtering device, not only do not impair the efficiency of the apparatus according to the invention, but instead tend to improve the operation thereof by unclogging the filtering walls.

Furthermore, an apparatus according to the invention is also advantageously characterized in that said motor comprises a body which is mounted in a longitudinal plane with the drive shaft inclined upwards and backwards by an angle greater than 0° and less than 90° relative to a horizontal, in particular between 30° and 75°, for example in the order of 50°.

An apparatus according to the invention is also advantageously characterized in that it comprises a pumping propeller coupled to an upper rear end of the drive shaft which opens at one side of the body of the motor, and in that another front lower end of the drive shaft opens at the other side of the body of the motor and is coupled to a bevel gear which drives two coaxial front half-axles which form a single front drive axle.

Advantageously, an apparatus according to the invention comprises a single axial pumping propeller directly mounted on one end of the drive shaft which acts as a rotation shaft for this propeller.

Advantageously and according to the invention, all of the electronic components of the apparatus are incorporated in the electric control unit which is located out of the liquid (not on-board) and connected to the hollow body and to the motor via a cable. In this production variant, the hollow body may therefore not have a specific electrical or electronic circuit. The electric control unit of an apparatus according to the invention can be simplified to an extreme degree. In this manner in particular, advantageously and according to the invention, the electric control unit is configured to supply electrical power to the motor in accordance with a value of the rotation speed of the drive shaft selected from a plurality of discrete absolute values of the rotation speed of the shaft, in particular, for the rear movement direction, in accordance with two values: a rapid value and a slow value.

Furthermore, preferably, an apparatus according to the invention does not have a mechanical cleaning member which is movable (that is to say, which is movably driven relative to the hollow body), such as a brush or a scraper, so that it is simplified to an extreme degree.

The invention also relates to an apparatus which is characterized in combination by all or some of the features mentioned above or below.

Figures 5, 6:
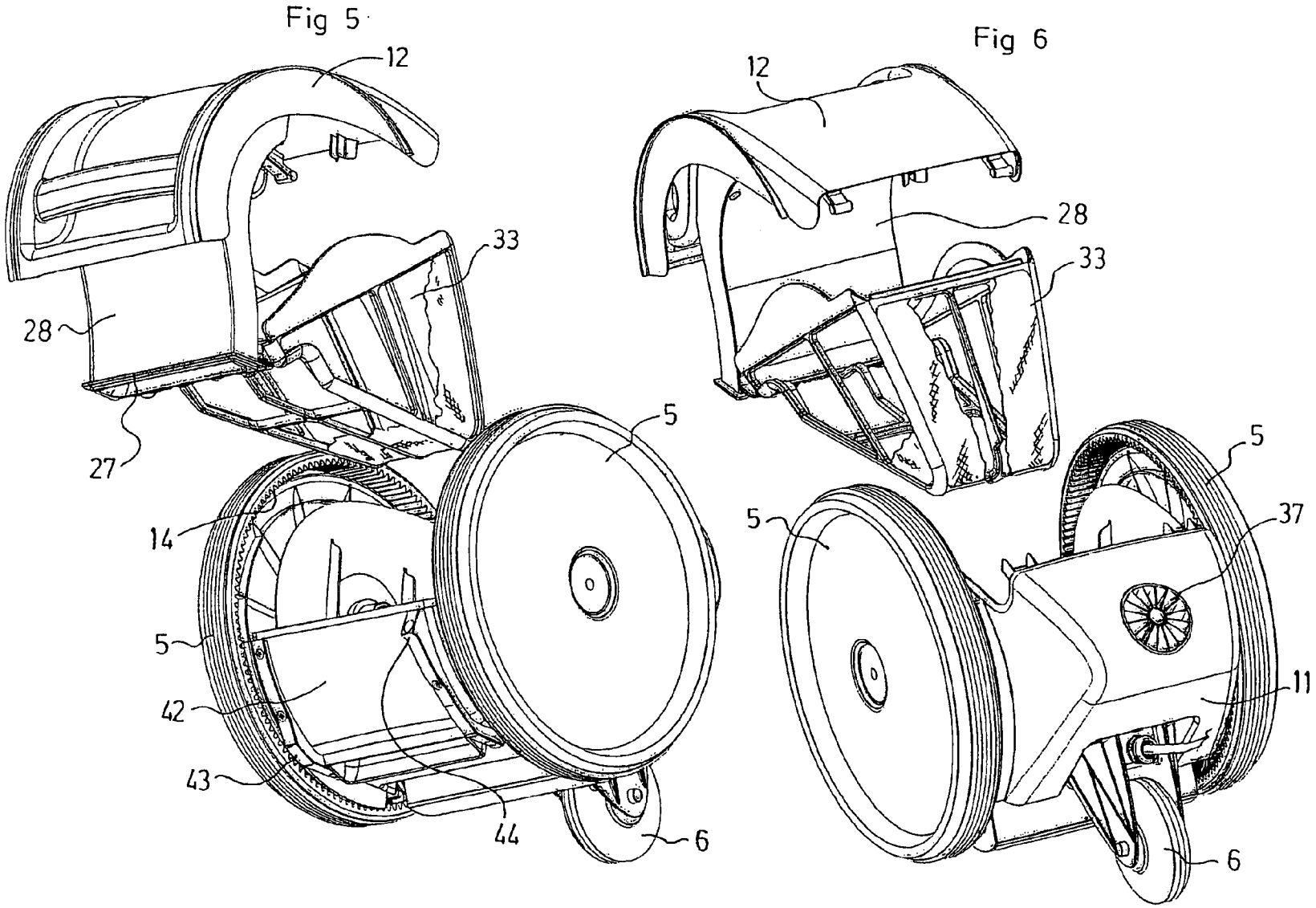
Figure 7:
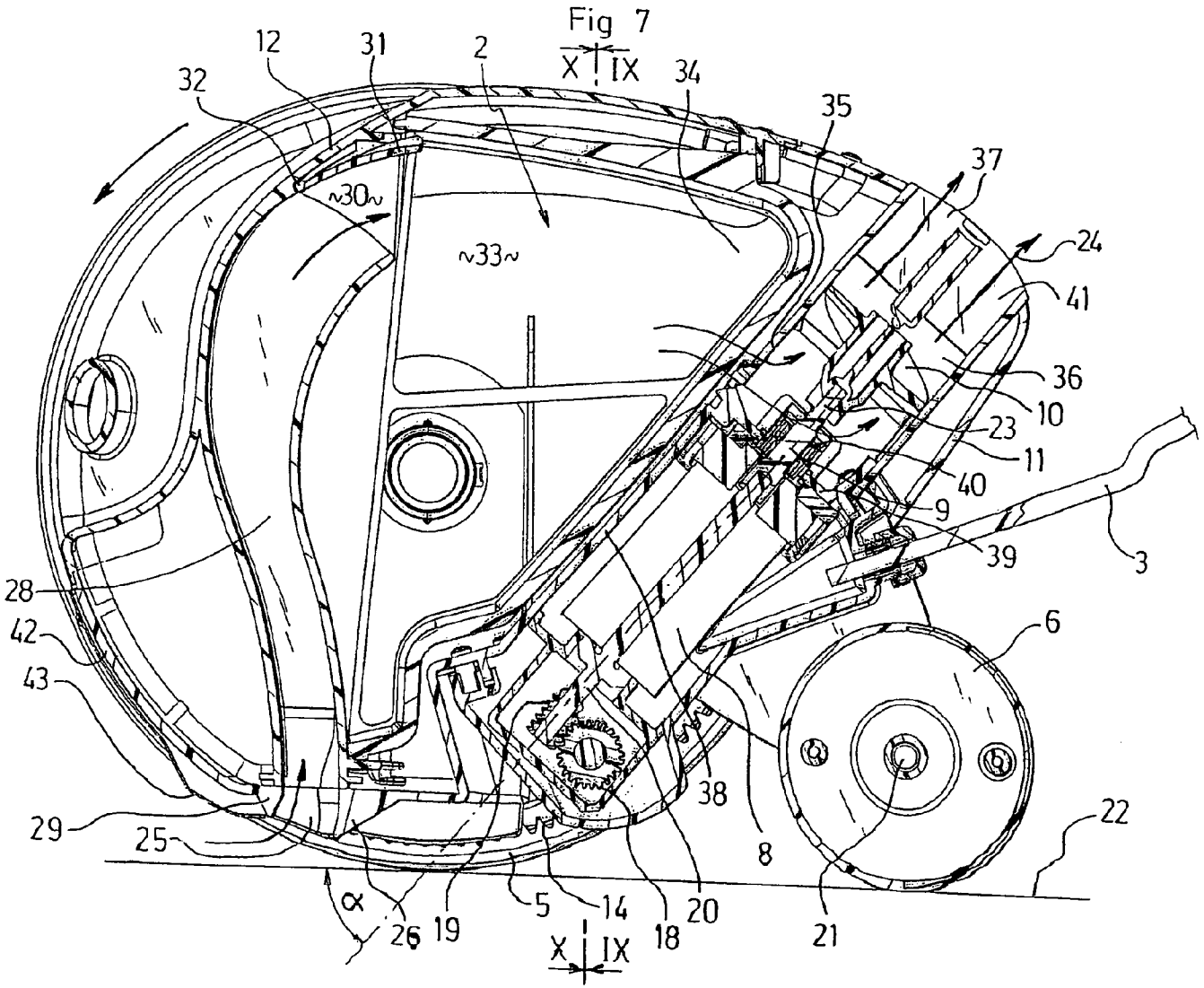
Figure 8:
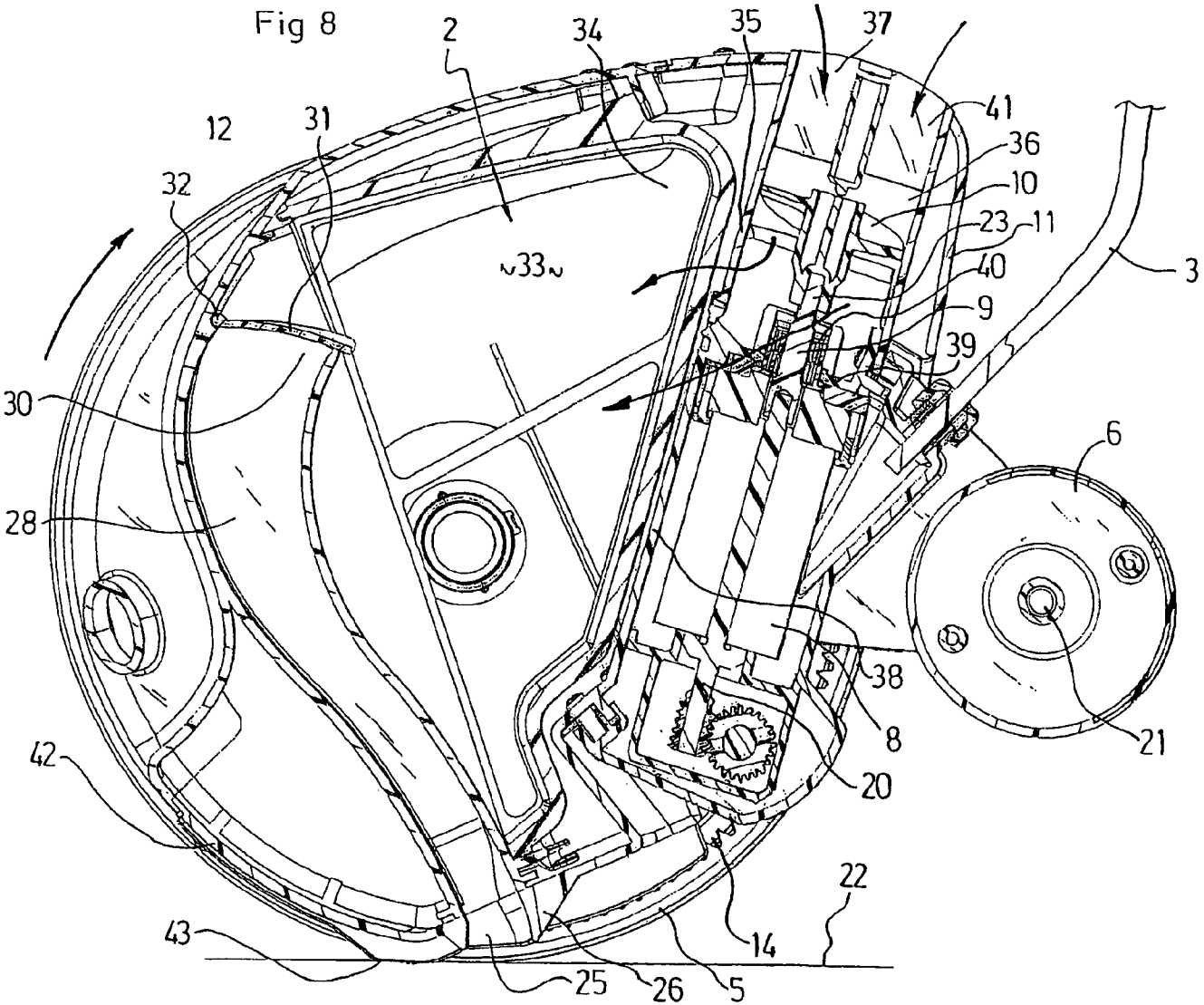
Figure 9:
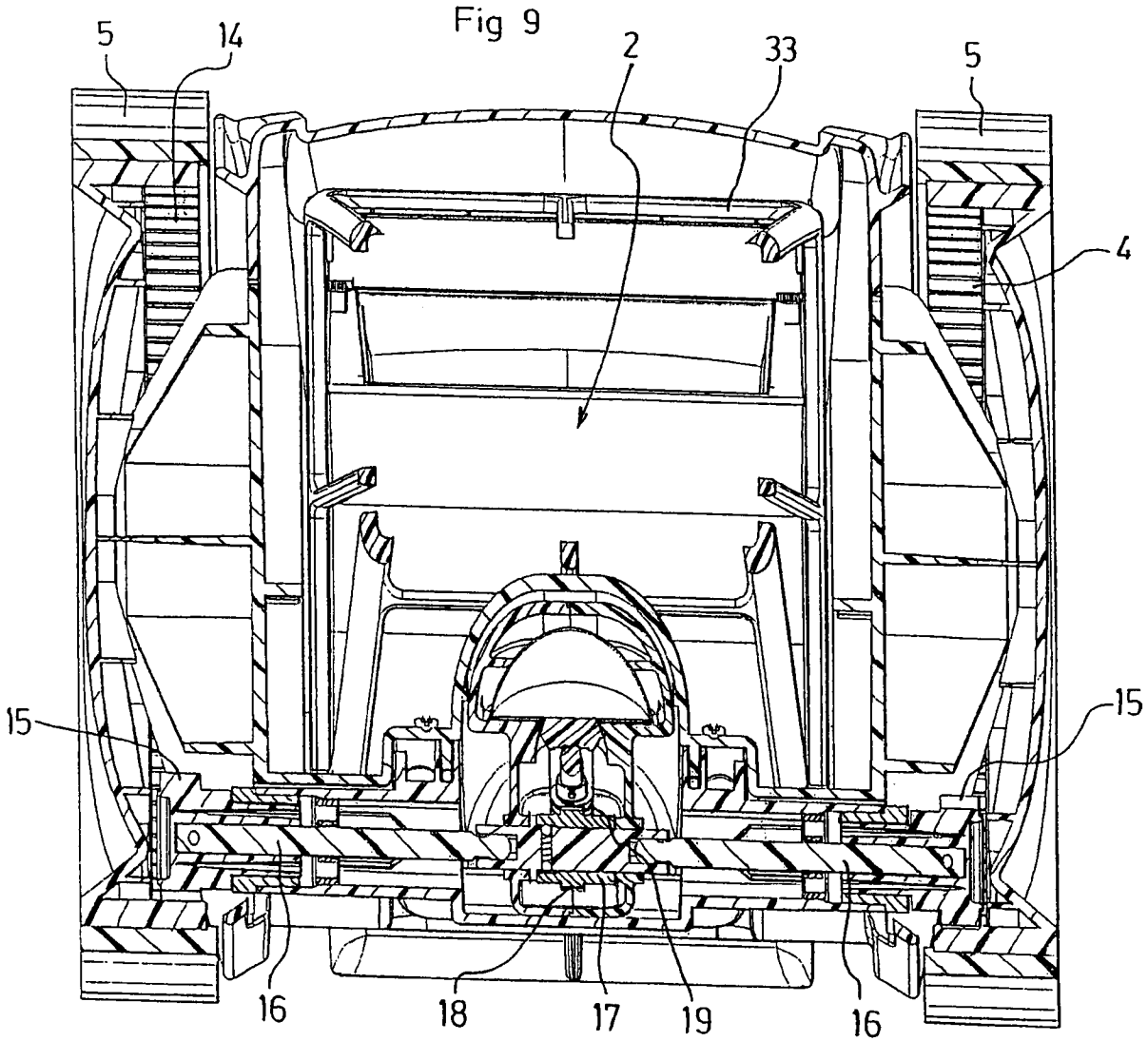
Figure 10:
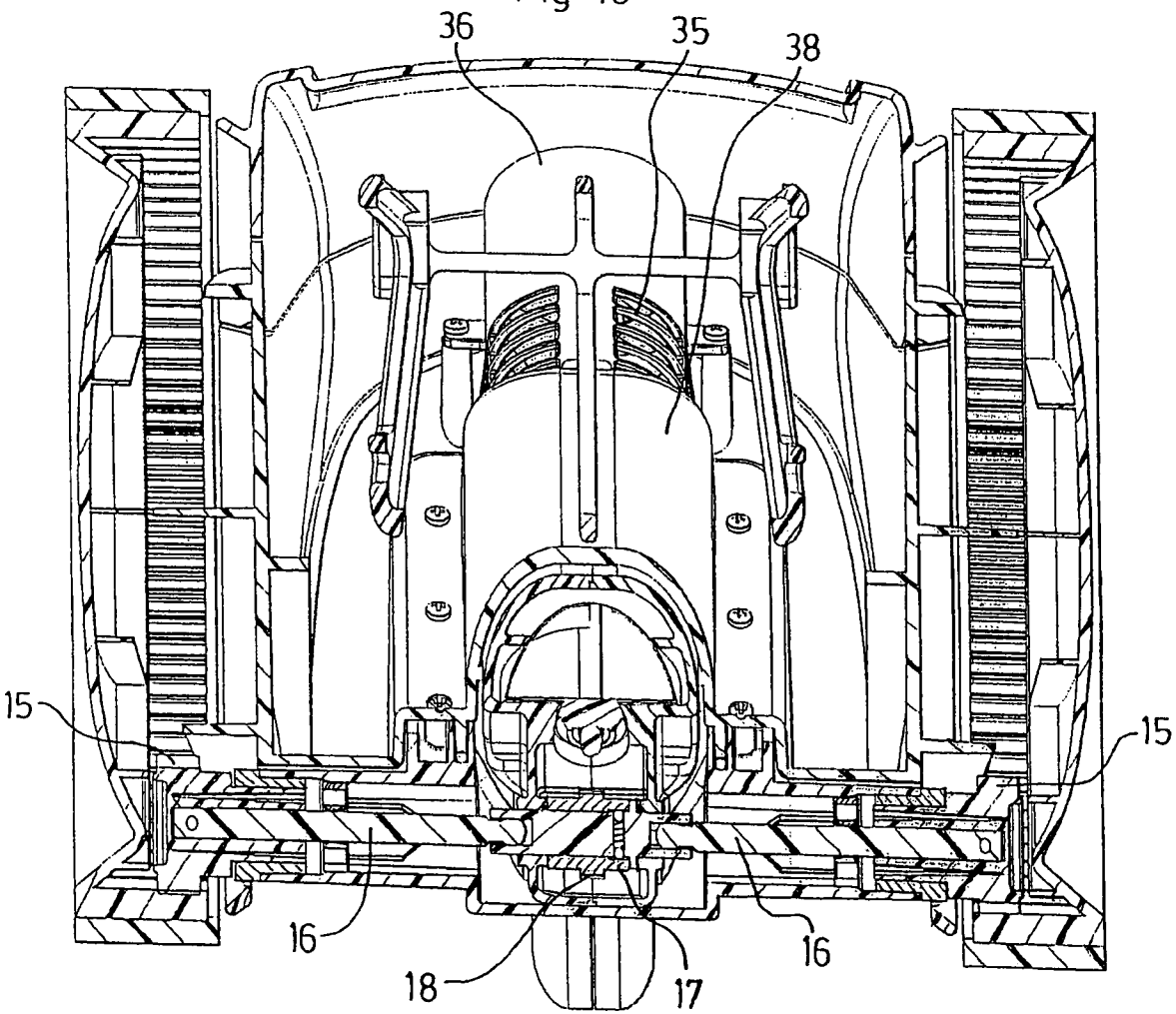
Figure 11A:
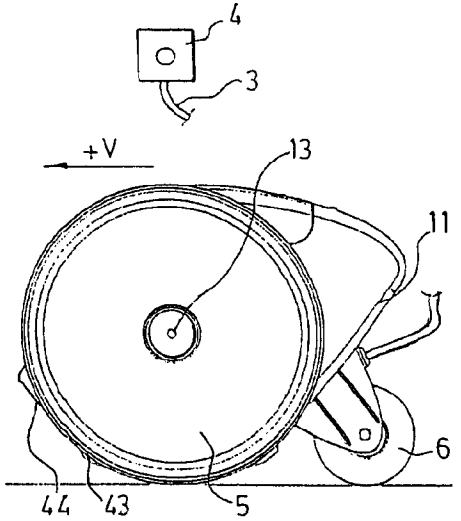
Figure 11B:
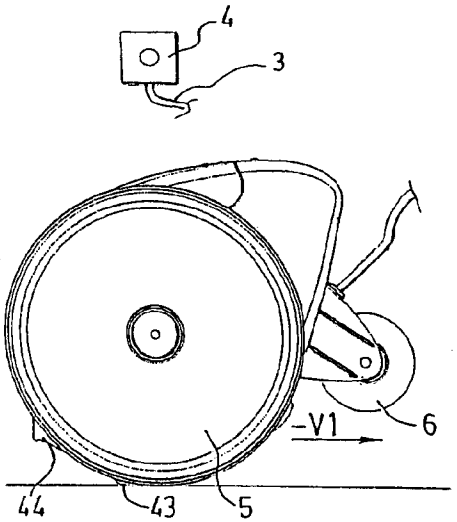
Figure 11C:
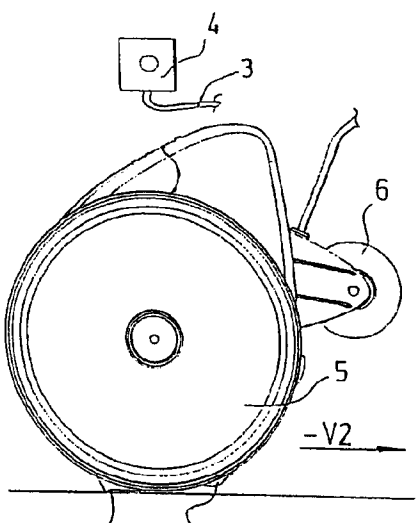
Figure 12A:
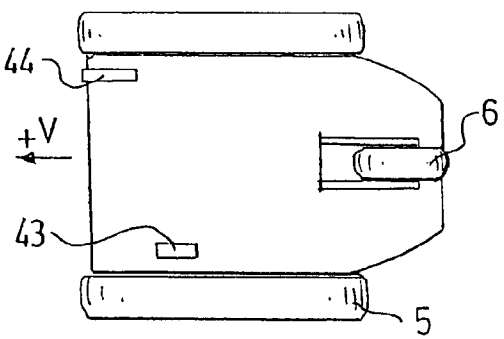
Figure 12B:
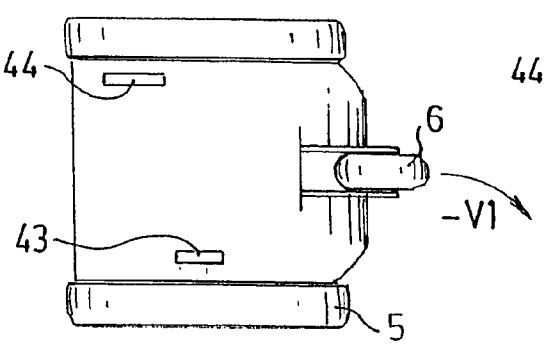
Figure 12C:
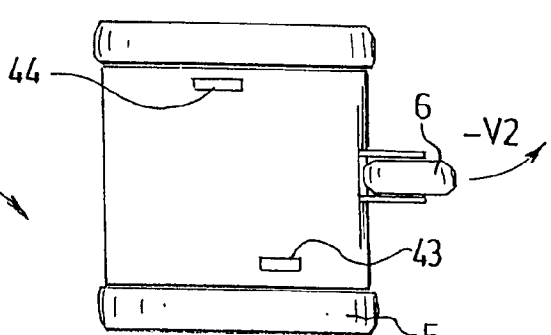

Other objects, features and advantages of the invention will be appreciated from a reading of the following description, which is given by way of non-limiting example and with reference to the appended Figures, in which:

FIGS. 1 to 4 are schematic perspective views from different angles (three-quarter upper front, three-quarter upper rear, three-quarter lower front and three-quarter lower rear, respectively) of an apparatus according to one embodiment of the invention, FIGS. 5 and 6 are exploded schematic perspective views from two different angles (three-quarter lower front and three-quarter upper rear, respectively) of the apparatus according to the invention of FIGS. 1 to 4, FIG. 7 is a schematic section in a longitudinal vertical plane along line VII-VII of FIG. 1, illustrating the apparatus according to the invention driven in the normal forward cleaning movement direction, FIG. 8 is a schematic section along line VII-VII of FIG. 1, illustrating the apparatus according to the invention driven in a backward movement direction in a nosed-up movement position, FIG. 9 is a schematic section towards the rear along line IX-IX of FIG. 7, FIG. 10 is a schematic section towards the front along line X-X of FIG. 7, FIGS. 11*a* to 11*c* are schematic profile views of the apparatus according to the invention of FIGS. 1 to 4, respectively, in a normal movement position, in a first nosed-up movement position and in a second nosed-up movement position, FIGS. 12*a* to 12*c* are schematic bottom views of FIGS. 11*a* to 11*c*, respectively, in a normal movement position, in a first nosed-up movement position and in a second nosed-up movement position.

The apparatus according to the invention illustrated in the Figures is a self-propelling apparatus of the electrical type for cleaning an immersed surface, that is to say, which is connected only by an electric cable 3 to a control unit 4 located out of the liquid. All along the text, unless indicated otherwise, the apparatus is described with a movement position on an immersed surface (inclination in a plane containing the movement direction and orthogonal with respect to the immersed surface) which is assumed to be horizontal. Of course, the apparatus according to the invention can move equally well on non-horizontal surfaces, in particular inclined or vertical surfaces.

This apparatus comprises a hollow body 1 which is formed by different walls which are composed of rigid synthetic material and which are assembled with each other allowing, on the one hand, a filtration chamber 2 to be delimited and, on the other hand, a chassis to be formed which receives and carries guiding and driving members 5, 6, a single electric motor 8 which has a drive shaft 9, a mechanical transmission between the drive shaft 9 of the electric motor 8 and at least one guiding and driving member, called a motorized member 5, and an axial pumping propeller 10.

In the embodiment illustrated, the hollow body 1 has a rear lower shell 11 forming a chassis, supplemented by a front upper cover 12 which can be removed from the shell 11. The cover 12 is provided with a front transverse handle 47 which allows the apparatus to be handled and transported.

The shell 11 carries two large lateral front drive wheels 5 which are coaxial and which have the same diameter. The drive wheels 5 have the largest diameter possible which does not increase the vertical spatial requirement of the apparatus. That is to say, the diameter of the front wheels 5 corresponds at least to the overall height (dimension in the direction normal with respect to the rolling plane 22 on the immersed surface) of the apparatus according to the invention. For example, the diameter of the front wheels 5 is between 250 mm and 300 mm and in particular is in the order of 275 mm.

These large wheels 5 have been found to have significant and unexpected advantages. First of all, they prevent any untimely contact of a protruding portion of the hollow body with the immersed surface and thus allow this immersed surface to be protected to some degree during the operation of the apparatus. In turn, they provide a degree of protection for the hollow body itself with respect to impacts from external objects which only come into contact with the large wheels 5. They also ensure improved traction of the apparatus using the same electric motor. They are further particularly advantageous in the context of an apparatus which has at least one nosed-up position in at least one drive direction in so far as they considerably facilitate this nosing-up action. They limit the risks of becoming blocked on the irregularities (in particular hollows and/or reliefs) of the small immersed surface and have multiple contact zones with different orientations (top, front, bottom) with the immersed surface. By providing particularly efficient and effective guiding and driving, they allow the performance levels and features of the other necessary guiding members to be reduced (simple small wheel 6 in the examples illustrated), or allow them to be dispensed with (variant which is not illustrated). They also allow a transmission to be produced which is as direct as possible (with no intermediate gear stage) between the drive shaft and each wheel 5 which can be provided, to this end, with an internal toothed crown which is provided with a plurality of teeth and which brings about a large step-down in one stage. They are particularly advantageous in combination with a motor 8 having an inclined axis as described below.

The front wheels 5 are coupled via a mechanical transmission to the drive shaft 9 of the electric motor 8 and are therefore rotatably driven thereby. They thus form a front drive axle 7. Each front wheel 5 is guided in rotation on the shell 11 about a transverse axis 13 defining the axis of the front axle 7. Each front wheel 5 has an internal toothed crown 14 allowing to receive a pinion 15 which is mounted at the end of a drive half-shaft 16 which is coupled to a central bridge 17 which comprises a pinion 18 which is rotatably driven by an endless screw 19 at a front lower end 20 of the drive shaft 9. In this manner, when the drive shaft 9 is rotatably driven in one direction by the motor 8, the pinion 18 is rotatably driven in one direction, and each pinion 15 is also rotatably driven in one direction, which drives the corresponding front wheel 5 in one direction. When the drive shaft 9 is rotatably driven in the other direction, the pinions 18 and 15 are rotatably driven in the other direction, as are the front wheels 5. In this manner, the motor 8 allows the front drive wheels 5 to be driven in one or other of the two rotation directions, forwards and backwards.

The shell 11 also carries a small rear wheel 6 which can freely rotate (non-driving) about a transverse axis 21. This small wheel 6 constitutes a rolling guiding member which, in the example illustrated, is not a driving member, that is to say, does not carry out the driving function and is not directional, that is to say, its axis 21 is fixed and parallel with the axis 13 of the drive axle 5. The two front wheels 5 and the small rear wheel 6 define the same plane, called a rolling plane 22, which corresponds to the immersed surface when the apparatus is moving normally over the surface with a cleaning action, all the wheels 5, 6 being in contact with the immersed surface.

The single electric motor 8 acts not only as a drive motor for the drive wheels 5, but also as a pumping motor which drives the propeller 10 in rotation about the axis thereof. To this end, the drive shaft 9 of the motor 8 extends longitudinally through the body of the motor and opens axially so as to protrude at the two sides of the body of the motor, that is to say, with a front lower end 20 driving the wheels 5 as indicated above, and with a rear upper end 23 to which the pumping propeller 10 is directly coupled so as to be fixedly joined in rotation.

The shell 11 carries the electric motor 8 in an inclined position relative to the rolling plane 22, that is to say, with the drive shaft 9 (which opens axially at the two sides of the body of the motor) inclined at an angle a which is not 0° or 90° relative to the rolling plane 22. In particular the drive shaft 9 is not orthogonal relative to the rolling plane 22. The angle a of inclination is between 30° and 75°, for example in the order of 50°.The angle a is also the inclination angle of the axis of the propeller 10 and the orientation 24 of the hydraulic flux generated thereby. The angle a also corresponds to the general direction of the hydraulic reaction generated by the flux of liquid at the outlet 37 in a normal pumping direction and towards the filter 33 in a backward direction.

Such an inclination has a number of advantages, and in particular allows great compactness to be conferred on the apparatus according to the invention and allows the hydraulic reaction force resulting from the liquid flow generated by the propeller 10, in particular its component parallel with the rolling plane 22, to be used for driving the apparatus in a normal direction.

The shell 11 also has a lower opening 25 which extends transversely substantially over the entire width and which is slightly offset towards the front relative to the vertical transverse plane (orthogonal with respect to the rolling plane 22) which contains the axis 13 of the drive axle 7. This opening 25 forms a liquid inlet at the base of the hollow body in a normal pumping direction for cleaning the immersed surface.

This opening 25 preferably has a flap 26 which extends along the rear edge thereof and at the sides in order to facilitate the intake of debris. The opening 25 preferably also has a rib 29 which extends along its front edge, protruding downwards, in order to create a turbulence effect at the rear of this rib 29 which tends to disengage the debris from the immersed surface and accelerate the flux of liquid entering the opening 25.

The opening 25 is adapted to receive a lower end 27 of an inlet conduit 28 which is integral with the cover 12. The assembly constitutes a liquid inlet at the base of the hollow body 1, via which the liquid inlet is drawn in by the suction resulting from the pumping propeller 10 when it is driven in a normal pumping direction by the motor 8.

The conduit 28 generally extends over the entire width of the cover 12 and upwards (substantially orthogonally relative to the rolling plane 22) as far as an upper opening 30 which is provided with a pivoting shutter 31 which acts as a valve. The shutter 31 is articulated about a horizontal transverse axis 32 located at the front of the opening 30. The cover 12 is adapted to be able to receive and carry a filter 33 which extends at the rear of the conduit 28 so as to receive the liquid flow (loaded with debris) from the upper opening 30 of the inlet conduit 28. This filter 33 is formed by rigid filtering walls and is in liquid communication at the upper rear portion 34 thereof with an inlet 35 of a conduit 36 which receives the axial pumping propeller 10, this conduit 36 generally extending in the pumping orientation 24 of the liquid, in continuation towards the rear towards the top of the drive shaft 9, as far as a liquid outlet 37 out of the hollow body 1 via which the liquid is generally discharged in the orientation 24 when the propeller 10 is driven by the motor 8 in the normal pumping direction. The path of liquid in the normal pumping direction in the hydraulic circuit for liquid circulation thus formed between the liquid inlet 25 and the liquid outlet 37 through the filter 33 is illustrated schematically by arrows in FIG. 7. The shutter 31 which acts as a valve is located in the region of the inlet of the filter 33 which is aligned with the upper opening 30 of the inlet conduit 28. In a variant which is not illustrated, such a valve, whose function is to prevent, in a backward direction, any backflow of liquid out of the hollow body via the inlet 25 could be incorporated within the inlet conduit 28 itself.

The motor 8 is carried below an inclined fluid-tight lower wall 38 of the shell 11 which delimits the filtration chamber 2 receiving the filter 33. The upper end 23 of the drive shaft 9 extends through the fluid-tight wall 38 in a portion 39 thereof which forms the lower portion of the conduit 36 and this passage is itself fluid-tight, that is to say, is produced by a device 40 having sealing joint(s) (for example of the stuffing box type) which provide(s) the sealing between the rotating drive shaft 9 and the wall 38.

The main liquid outlet 37 out of the hollow body 1 is provided with a protective grill 41 which guides the flux generated in a normal pumping direction and which prevents the passage of debris in the backflow direction towards the inner side of the hollow body 1 when the propeller 10 is driven in a backward direction counter to the normal pumping direction.

The control unit 4 is preferably located out of the liquid and is configured to provide, via the cable 3, a supply voltage to the motor 8. This supply voltage, depending on its polarity, allows the motor 8 to be controlled in one direction or the other and in different rotation speeds. Such a control unit 4 can be formed by an electrical power supply which is branched with respect to the mains supply and comprises a pulse width modulation control logic unit which controls a circuit which forms a voltage source (based on at least one transistor in commutation) whose output is chopped at high frequency with a pulse width which is variable in accordance with the signal supplied by the control logic unit. The control unit 4 comprises an inversion circuit which allows a supply voltage to be provided for the motor 8 whose polarity can be changed (positive polarity for driving in a forward direction; negative polarity for driving in a backward direction) and whose mean value can be modified owing to the pulse width modulation logic unit in order to take a value from a plurality of different values corresponding to several drive speeds of the motor 8, respectively, and therefore to several movement speeds of the apparatus. The sign + indicates a movement in a forward direction; the sign − indicates a movement in a backward direction. In the example, if it is desirable for the apparatus to be able to move at a normal predetermined speed +V in a forward direction, at a first speed −V1 in a backward direction or at a second speed −V2 in a backward direction, the control logic unit can be programmed so that the control unit 4 provides a voltage whose mean value can take, at an absolute value, a value selected from three predetermined values corresponding to these three speeds.

The control unit 4 may advantageously incorporate a time delay logic unit which allows the various drive directions and the various speeds to be controlled in accordance with periods of time which are predetermined, fixed and stored and/or defined randomly, for example by a pseudo-random variable generator. Such a control unit 4 is particularly simple in terms of its design and production.

In a first rotation direction of the motor 8 and the shaft 9 thereof, the front drive wheels 5 are rotatably driven in the forward movement direction of the apparatus (FIGS. 7 and 11*a*, the small wheel 6 being at the rear of the drive axle in contact with the immersed surface). In this first rotation direction, the axial pumping propeller 10 is driven in the normal pumping direction of the liquid from the opening 25 at the base of the hollow body 1 as far as the outlet 37 via which the liquid is discharged. The shutter 31 is open and the pieces of debris drawn in via the opening 25 with the liquid are retained in the filter 33.

In this first rotation direction, the motor 8 is controlled at a predetermined speed so that the apparatus is moved in a forward direction at a predetermined speed +V, called a normal speed, which is as rapid as possible in order to optimize the cleaning. Preferably, the normal speed +V corresponds to the maximum rotation speed of the motor 8. When the apparatus is thus driven in a forward direction, its trajectory is normally straight orthogonal with respect to the axis 13 of the axle 7, the two front wheels 5 being parallel with each other and orthogonal with respect to the axis 13, and the small wheel 6 being in contact with the immersed surface.

In the other rotation direction of the motor 8, the front drive wheels 5 are rotatably driven in a backward movement direction of the apparatus (FIG. 8, the small wheel 6 being in front of the drive axle 7 relative to this movement direction). In this second rotation direction, the axial pumping propeller 10 is driven in the opposite direction to its normal pumping direction and generates a non-zero flow of liquid in a backward direction from the outlet 37 to the inner side of the hollow body 1. The propeller 10 is an axial pumping propeller which has unidirectional pitch and is preferably fixed (having blades which are rigidly fixed to a rotor and which extend radially relative thereto having a pitch in a single direction) and generates a flow of liquid generally orientated in accordance with the rotation axis thereof (therefore, the propeller 10 not being of the centrifugal type) in one direction or the other in accordance with the direction of rotation of the propeller about the axis thereof. The propeller 10 is optimized to generate an optimum flow when it is rotatably driven about its axis in the normal pumping direction. However, when it is rotatably driven about the axis thereof in an opposite direction to the normal pumping direction, the propeller 10 generates a non-zero flow of liquid in a backward direction.

And, against all expectations in this matter, not only is this backward flow in reality not disadvantageous for the general operation of the apparatus, it is instead particularly advantageous and in particular allows:

- a hydraulic reaction to be applied which can be involved in the nosing-up action of the apparatus which brings about modifications of the trajectory of the apparatus during its movements in a backward direction, in terms of gyration at one side or the other,
- hydraulic fluxes optionally to be generated which are orientated laterally and are directly involved by reaction in the trajectory modifications of the apparatus, in terms of gyration at one side or the other,
- the walls of the filter 33 to be periodically unclogged, which serves to increase the service-life of the apparatus and to optimize the operational volume of the filter 33.

In this second rotation direction of the motor 8, the shutter 31 is automatically in a closed position (owing to gravity and/or under the action of the flux in a backward direction), preventing any backflow of debris into the conduit 28 so that the pieces of debris remain confined inside the filter 33. The flux in a backward direction can be discharged via the inevitable leakages of the apparatus (the apparatus being able to have no specific discharge hole or valve for the flux in a backward direction), or via one or more specific hole(s) having valve(s) provided in the shell 11 for this purpose, for example a lateral hole (variant which is not illustrated).

The trajectory modifications of the apparatus during its movements in a backward direction (compared with its trajectory in a forward direction which is in a straight line in the example) can be obtained in all appropriate manners from a modification of the position of the hollow body 1 relative to the axle 7 about the axis 13 (in a plane which is orthogonal with respect to the immersed surface and contains the movement direction).

Preferably, the apparatus is configured so as to be able to be driven in terms of gyration at one side (for example to the left relative to its movement direction) for a first speed of the motor 8 corresponding to a first speed −V1 of movement of the apparatus in a backward direction and to a first position, nosed-up or not nosed-up, of the apparatus, and in terms of gyration at the other side (for example to the right relative to its movement direction) for a second speed of the motor 8 corresponding to a second speed −V2 of movement of the apparatus in a backward direction and a second nosed-up position of the apparatus, this second speed −V2 being different, in particular more rapid, than the first speed −V1. In this manner, there is obtained in an extremely simple manner an apparatus which, in the forward direction, moves in a straight line and, in a backward direction, depending on the rotation speed of the motor 8, moves by turning to the left or by turning to the right. Consequently, all the useful trajectories of a cleaning apparatus are obtained, which greatly facilitates the cleaning coverage and the rapidity of cleaning the immersed surface.

The increase of the movement speed in a backward direction generates an acceleration which brings about an inertia torque tending to increase the nosing-up action of the apparatus. The general balance of the apparatus can be configured in order to obtain the desired positions which are nosed-up to a greater or lesser extent or not nosed-up, in the various corresponding speeds.

In a variant which is not illustrated, the pumping device may also be involved in the placement into (a) nosed-up position(s). In this regard, it should be noted that the pumping propeller 10 is a propeller with unidirectional pitch which is directly coupled so as to be fixedly joined in rotation to the rear upper end 23 of the drive shaft 9. An axial pumping propeller with unidirectional pitch comprises blades which generally extend radially and which have a pitch which is preferably fixed but which could be variable but which, in any case, does not change direction, that is to say, is always orientated in a single direction, so that the liquid flux direction generated by the rotation of the propeller is dependent on the rotation direction thereof. When the propeller 10 is rotatably driven in the normal pumping direction (corresponding to the cleaning of the immersed surface), it pumps the liquid from each liquid inlet at the base of the hollow body as far as each main liquid outlet. When the propeller 10 is rotatably driven in a backward direction, it pumps the liquid in the direction of the backflow from each main liquid outlet.

The axial pumping propeller 10 which is driven in a backward direction generates a flow of liquid which is able to be discharged from the hollow body via at least one liquid outlet, called a secondary outlet (not illustrated). The liquid flow which is discharged via at least one such secondary outlet is orientated so that this current creates, by means of reaction, forces whose resultant, called a secondary hydraulic reaction force, generates a nosing-up torque of the apparatus by pivoting the hollow body about the axle 7. This nosing-up torque about the axis 13 of the drive axle 7 tends to nose-up the apparatus, that is, to raise the small wheel 6. In this manner, such a secondary hydraulic reaction force applies a pivot torque of the apparatus about the axis 13 of the drive axle 7 in the direction in which the nosing-up action of the apparatus is increased. To this end, it is necessary and sufficient for the orientation of the liquid flux generated in a backward direction and being discharged via such a secondary outlet not to intersect with the axis 13 of the drive axle 7, and to be orientated in the correct direction in order to at least participate in the nosing-up action of the hollow body about the nosing-up axle. However, such an involvement of the liquid flux in a backward direction in placing the apparatus in a nosed-up state is not necessary and, in the embodiment illustrated by way of example, obtaining each nosed-up position results only from the drive torque on the drive axle and the general balance of the apparatus.

Trajectory modifications can be obtained in accordance with the position, which is nosed-up to a greater or lesser extent or not nosed-up, that is to say, in accordance with the inclination of the hollow body 1 about the axis 13 of the drive axle 7 relative to the immersed surface, for example (non-illustrated variant) owing to the fact that the horizontal component (parallel with the immersed surface) of the hydraulic advance resistance in the backward direction is unbalanced and brings about a gyration at one side of the apparatus. To this end, the shell 11 may have shutters or ribs whose hydraulic effect is dependent on the nosed-up inclination of the apparatus.

According to another variant which is not illustrated, they can be obtained by laterally offsetting a guiding and driving member and/or brushing member, or in accordance with a spontaneous pivoting action of a small wheel following the change in movement direction.

In a variant or in combination, trajectory modifications can be obtained by means of different configurations of the guiding and driving members in contact with the immersed surface and/or by laterally offset braking members which may or may not come into contact with the immersed surface in accordance with the nosed-up position of the apparatus.

In the preferred variant illustrated, the shell 11 has a wall portion 42 which extends forwards from the opening 25, over the entire width thereof, substantially conforming to the contour of the front wheels 5. This wall portion 42 is provided with two runners 43, 44, each runner being arranged so as to be able to come into contact with the immersed surface in order to locally brake and/or disengage the hollow body 1 if the apparatus takes up a specific predetermined nosed-up position for each runner 43, 44, the small wheel 6 being disengaged from said immersed surface.

A first fixed runner 43 is arranged at one side, for example at the right-hand side as illustrated, integral with the front portion 42 of the shell 11 and extends so as to protrude radially outwards from this portion 42 in order to come into contact with the immersed surface when the apparatus is in a first nosed-up position illustrated in FIG. 11*b*, for the first slow movement speed −V1 in a backward direction corresponding to the first slow rotation speed of the motor 8. In this first nosed-up position, the second runner 44 is not in contact with the immersed surface and the apparatus is driven in terms of gyration at one side (to the left relative to the movement direction in the example illustrated) and in a backward direction owing to the friction of the first runner 43 on the immersed surface and/or disengagement of the front right wheel 5. The first runner 43 is arranged at the front of the drive axle and, in the first nosed-up position, comes into contact with the immersed surface at the rear of the drive axle relative to the movement direction (backward direction).

The second fixed runner 44 is arranged at the other side, for example at the left-hand side as illustrated, integral with the front portion 42 of the shell 11 and extends so as to protrude radially outwards from this portion 42 in order to come into contact with the immersed surface when the apparatus is in a second nosed-up position which is illustrated in FIG. 11*c* and which has a greater inclination than the first nosed-up position. This second nosed-up position is obtained for the second rapid speed −V2 of movement in a backward direction which corresponds to the second rapid rotation speed of the motor 8. In this second nosed-up position, the first runner 43 is no longer in contact with the immersed surface and the apparatus is driven in terms of gyration at the other side (to the right in the example illustrated) in a backward direction owing to the friction of the second runner 44 on the immersed surface and/or disengagement of the front left wheel 5 The second runner 44 is also arranged at the front of the drive axle and, in the second nosed-up position, comes into contact with the immersed surface at the rear of the drive axle relative to the movement direction (backward direction).

The first runner 43 is arranged so as to come into contact with the immersed surface only in said first nosed-up position and the second runner 44 is arranged so as to come into contact with the immersed surface only in said second nosed-up position. In particular, in the first nosed-up position, the second runner 44 is not in contact with the immersed surface. In the second nosed-up position, the first runner 43 is not in contact with the immersed surface. In the normal movement position of the apparatus in which it is not nosed-up, since all the wheels 5, 6 are in contact with the immersed surface, for example during the movements in a forward direction, the runners 43, 44 are remote from the immersed surface and are therefore inactive.

A runner 43, 44 which is capable of causing a drive wheel 5 to become disengaged brings about a rapid gyration of the apparatus by means of localized stoppage. A runner 43, 44 which is capable of rubbing against the immersed surface without causing a drive wheel 5 to become disengaged brings about a slower gyration of the apparatus by localized braking. These two variants can be envisaged in an apparatus according to the invention, and can be combined (at least one braking runner being provided for only rubbing on the immersed surface and locally braking in one position of the apparatus; at least one other disengagement runner bringing about a disengagement of a wheel in another position of the apparatus).

In this manner, an apparatus according to the invention comprises at least one runner 43, 44 which is arranged so as to come into contact with the immersed surface in at least one nosed-up position of the apparatus in order to bring about a gyration of the apparatus at one side. Such a runner is inactive (remote from the immersed surface) when the hollow body is in its normal operating position (cleaning of the immersed surface) and can be adapted so as to only locally brake the hollow body by means of friction contact with the immersed surface when it is in a predetermined nosed-up position, thereby bringing about a gyration at one side. In a variant, such a runner can be adapted to locally disengage the hollow body and at least one member for guiding the nosing-up axle—in particular a motorized guiding and driving member—located close to the runner. Furthermore, such a runner may be arranged so as to be laterally offset relative to the nosing-up axle (relative to a median direction of the nosing-up axle) in order to bring about local braking or disengagement of a guiding member—in particular a motorized guiding and driving member—and therefore a gyration of the apparatus at one side predetermined in this manner; or, in a variant which is not illustrated, can instead be generally centered in a median direction of the nosing-up axle in order to bring about disengagement of each guiding member—in particular each motorized guiding and driving member—the apparatus being driven in terms of gyration at one side or the other (defined in a random manner) owing to inevitable operational imbalances owing, for example, to the traction of the electrical power supply cable.

The control unit 4 is extremely simple in terms of its design and production. It is adapted so that the apparatus is principally driven forwards in a straight line. The motor 8 is interrupted from time to time and controlled in a backward direction at the first slow speed (corresponding to the movement speed −V1) from time to time and at the second rapid speed (corresponding to the movement speed −V2) from time to time. The different time periods for control of the motor 8: T1 in a forward direction at rapid speed +V, T2 in a backward direction at slow speed −V1, T3 in a backward direction at normal rapid speed −V2, and T4 the interruptions of the motor 8, are defined in a random manner (by a random generator, that is to say, a pseudo-random variable generator) and/or in a predetermined manner. Preferably, these time periods can be defined so as to limit the entanglement of the cable 3, that is to say, ensuring that the totals of the periods of time of gyration to the left are similar to the totals of the periods of time of gyration to the right.

For example, T1 is between 10 sec. and 1 min., for example in the order of 20 sec.; T2 and T3 are both less than T1, for example between 3 sec. and 15 sec., in particular between 5 sec. and 8 sec.; and T4 is less than each of the periods of time T1, T2 and T3 and is between 0.5 sec. and 5 sec., in particular in the order of 2 sec. The value V corresponds to the maximum speed of the motor 8 (no pulse width modulation of the voltage supplied by the control unit 4), V1 corresponds to 50% of the maximum speed of the motor (V1=0.5V) and V2 corresponds to 80% of the maximum speed of the motor (V2=0.8V). Of course, other values are possible.

It should be noted that the control of each nosed-up position of the apparatus does not require a particularly complex operational logic unit in so far as it can be obtained by means of simple balance of the apparatus during production. Furthermore, the presence of the runners 43, 44 facilitates this control, each of these runners 43, 44 acting as a stop which limits the pivoting into each nosed-up position. Furthermore, this control can remain relatively imprecise if the periods of time for placing the apparatus in a nosed-up position are short, this movement configuration not corresponding to the normal cleaning configuration.

The apparatus according to the invention is extremely simple in terms of design and production and therefore very economical but nevertheless very efficient. With a single electric motor 8 and a control unit 4 which is reduced to its most simple form, all the most complex functionalities of an electrical apparatus are obtained. The apparatus according to the invention is further particularly light, easy to handle, ergonomic and particularly aesthetic. It consumes very little energy and is environmentally friendly. It has a great service-life and excellent inherent reliability particularly of the small number of components which it contains.

The invention may include numerous variants from the preferred embodiment illustrated in the Figures and described above. In particular, the invention can be used equally well in an apparatus which is provided with motorized or non-motorized guiding and driving members other than wheels (chains, brushes, etc.). Also, the apparatus may have several liquid inlets, several liquid outlets, or even several pumping propellers which are driven by the same motor. However, one advantage of an apparatus according to the invention is that it is able to have only one liquid inlet 25, only one liquid outlet 37, only one hydraulic circuit and a single axial pumping propeller 10 which is coupled directly to the drive shaft 9 of the electric motor 8. The motor 8 can be driven in accordance with a discrete plurality of speeds which may comprise more different speeds than in the example described above. The runners 43, 44 may be replaced or supplemented by a runner generally centered in a median direction of the axle (not laterally offset) which brings about, in a predetermined nosed-up position of the apparatus, a disengagement of the two drive wheels 5 and a random gyration of the apparatus owing to the inevitable imbalances thereof (for example owing to the necessarily eccentric traction of the electrical power supply cable).

The apparatus according to the invention advantageously has no actuator or on-board logic circuit and/or electronic circuit. In variants, there is nothing to prevent the apparatus from being able to comprise, if necessary, on-board electronic components and/or actuators. For example, the control unit could be on-board, including for example with a series of on-board accumulators which act as a source of electrical energy, the apparatus being completely independent.

The invention claimed is:

1. A swimming pool cleaner comprising:

a. a body defining a water inlet thereto and a water outlet therefrom;

b. a reversible electric motor carried by the body and comprising a drive shaft;

c. a filtering device carried by the body for filtering at least some water passing through the water inlet;

d. a driving member mechanically connected to the reversible electric motor;

e. pumping means (i) mechanically connected to the reversible electric motor, (ii) positioned at least partly within the body, (iii) being the only means for drawing water into the body, and (iv) comprising an axial pumping propeller with unidirectional pitch; and f. an electric control unit which is configured to control the reversible electric motor both (i) in a first rotation direction of the drive shaft so as to (A) drive the driving member in a first direction and (B) cause the axial pumping propeller to generate a flow of water from the water inlet toward the water outlet and (ii) in a second rotation direction opposite the first rotation direction so as to drive the driving member in a second direction opposite the first direction.

2. A swimming pool cleaner according to claim 1 in which the pumping means is positioned wholly within the body.

3. A swimming pool cleaner according to claim 1 in which the axial pumping propeller is configured, in the second rotation direction of the drive shaft, to generate a non-zero flow of liquid in a backward direction from the water outlet in the direction of backflow toward the water inlet.

4. A swimming pool cleaner according to claim 1 in which the filtering device comprises a non-return valve which is arranged upstream of the filtering device relative to the flux of water in the normal pumping direction of the water, the non-return valve being arranged to prevent, in a backward direction, the backflow of the water out of the filtering device and from the body.

5. A swimming pool cleaner according to claim 4 in which the filtering device has an inlet which is arranged upstream relative to the flow of water in the normal pumping direction of the water, and wherein a valve is arranged at the inlet upstream of the filtering device,

6. A swimming pool cleaner according to claim 1 in which the reversible electric motor comprises a body which is mounted in a longitudinal plane with the drive shaft inclined upward and backward by an angle greater than 0° and less than 90° relative to a rolling plane defined by the driving member.

7. A swimming pool cleaner according to claim 6 in which. the drive shaft includes an upper rear end and a lower front end and the axial pumping propeller is coupled to the upper rear end, further comprising a bevel gear coupled to the lower front end and which drives two coaxial front half-shafts for a single front drive axle.

8. A swimming pool cleaner according to claim 1 in which the axial pumping propeller is directly mounted on the drive shaft, which acts as a rotation shaft for the axial pumping propeller,

9. A swimming pool cleaner according to claim 1 in which the electric control unit is configured to supply electrical power to the reversible electric motor in accordance with a value of a rotation speed of the drive shaft selected from a plurality of absolute discrete values of the rotation speed of the drive shaft.

10. A swimming pool cleaner according to claim 9 in which the plurality of values comprises, for the backward movement direction, a rapid value and a slow value.

11. A swimming pool cleaner according to claim 1 in which the electric control unit is configured to control the reversible electric motor principally in the first rotation direction and in accordance with shorter periods of time in the second rotation direction.

12. A swimming pool cleaner according to claim 1 in which at least any electric components of the electric control unit are located out of the water and are electrically connected to the body and to the reversible electric motor via a cable.

* * * * *